United States Patent [19]

Mikoshiba et al.

[11] Patent Number: 4,975,409

[45] Date of Patent: Dec. 4, 1990

[54] HEAT TRANSFER DYE PROVIDING MATERIAL

[75] Inventors: Hisashi Mikoshiba; Mitsugu Tanaka; Seiiti Kubodera, all of Kanagawa, Japan

[73] Assignee: Fuji Photo Film Co., Ltd., Kanagawa, Japan

[21] Appl. No.: 434,956

[22] Filed: Nov. 9, 1989

[30] Foreign Application Priority Data

Nov. 11, 1988 [JP] Japan ..... 63-285406

[51] Int. Cl.[5] ..... B41M 5/035; B41M 5/26

[52] U.S. Cl. ..... 503/227; 8/471; 428/195; 428/336; 428/913; 428/914

[58] Field of Search ..... 8/471; 428/195, 913, 428/914, 336; 503/227

[56] References Cited

U.S. PATENT DOCUMENTS 4,873,220 10/1989 Kubodera et al. ..... 503/227

FOREIGN PATENT DOCUMENTS 1268493 11/1986 Japan ..... 503/227

88/02699 4/1988 World Int. Prop. O. ..... 503/227

*Primary Examiner*—Bruce H. Hess

*Attorney, Agent, or Firm*—Sughrue, Mion, Zinn, Macpeak & Seas

[57] ABSTRACT

A heat transfer dye providing material is described, having on a support a dye providing layer containing a binder and a dye represented by formula (I):

(I)

wherein

Q represents an atomic group forming a five or more membered carbocyclic ring or a five or more membered heterocyclic ring containing at least one nitrogen atom;

$R^1$ represents an alkyl group, an alkoxy group, a halogen atom, an acylamino group, an alkoxycarbonyl group, a cyano group, a sulfonylamino group, a carbamoyl group, a sulfamoyl group, an aminocarbonylamino group, or an alkoxycarbonylamino group;

$R^2$, $R^3$, $R^4$, $R^5$ and $R^6$ each represents a hydrogen atom or a group selected from the groups as defined for $R^1$;

$R^7$ represents a hydrogen atom, an alkyl group, or an aryl group; and at least one of $R^4$ and $R^7$, $R^3$ and $R^4$, and $R^5$ and $R^6$ may be taken together to form a ring.

In accordance with the invention, an image with a cyan dye of high light fastness is provided.

3 Claims, No Drawings

HEAT TRANSFER DYE PROVIDING MATERIAL

FIELD OF THE INVENTION

The present invention relates to a heat transfer dye providing material.

BACKGROUND OF THE INVENTION

Heat sensitive transfer methods, electrophotographic methods and ink jet methods are currently being actively studied as technology relating to color hard copy. Compared to other methods, heat sensitive transfer has many advantages due to the ease of maintenance and operation of equipment, and the low cost of equipment and expendable items.

Methods of heat sensitive transfer include a method whereby a heat transfer dye providing material comprising a heat fusible ink layer formed on a support is heated by a thermal head to melt the ink and record the image on a heat transfer image receiving material, and a method whereby a heat transfer dye providing material comprising a dye providing layer containing a thermomigrating dye formed on a support is heated by a thermal head or the like to transfer the dye to a heat transfer image receiving material. Since the latter transfer method using thermomigrating dyes makes it possible to vary the amount of dye transferred by altering the energy supplied to the thermal head, gradation recording is easy and it is particularly advantageous in making high quality full color records.

However, there are various restrictions on the thermomigrating dyes used in this method, and there are very few which satisfy all performance requirements.

The performance requirements include, for example, having desirable spectroscopic characteristics in color reproduction, being easy to sublimate and move through a medium using heat, being resistant to light and heat, being resistant to a variety of chemicals, not easily having sharpness reduced, the image not being easily re-transferable, being easily synthesizable, and being easy to prepare a heat sensitive transfer material. The development of a cyan dye satisfying these requirements has been particularly hoped for.

A variety of suggestions have been put forward for cyan dyes for use in heat transfer, and among these the indoaniline-based dyes disclosed in JP-A-61-268493, JP-A-62-191191 and JP-A-63-91287 have a relatively superior performance (the term "JP-A" as used herein means an "unexamined published Japanese patent application"). However, the indoaniline dyes proposed so far suffer from the disadvantage that their light fastness is poor.

An object of the present invention is to provide a heat transfer dye providing material containing a cyan dye in which the above problem has been overcome.

SUMMARY OF THE INVENTION

The above object of the invention is achieved by a heat transfer dye providing material having on a support a dye providing layer containing a binder and a dye represented by formula (I):

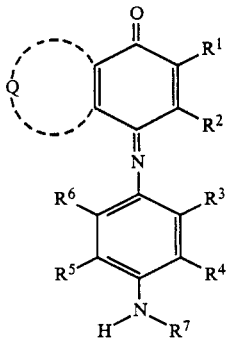

(I)

wherein

Q represents an atomic group forming a five or more membered carbocyclic ring or a five or more membered heterocyclic ring containing at least one nitrogen atom;

$R^1$ represents an alkyl group, an alkoxy group, a halogen atom, an acylamino group, an alkoxycarbonyl group, a cyano group, a sulfonylamino group, a carbamoyl group, a sulfamoyl group, an aminocarbonylamino group, or an alkoxycarbonylamino group;

$R^2$, $R^3$, $R^4$, $R^5$ and $R^6$ each represents a hydrogen atom or a group selected from the groups as defined for $R^1$;

$R^7$ represents a hydrogen atom, an alkyl group, or an aryl group; and at least one of $R^4$ and $R^7$, $R^3$ and $R^4$, and $R^5$ and $R^6$ may be taken together to form a ring.

The above substituent groups may be substituted by still further substituent groups.

DETAILED DESCRIPTION OF THE INVENTION

Formula (I) is now described in more detail.

Q represents an atomic group forming a five or more membered carbocyclic ring or a five or more membered heterocyclic ring containing at least one nitrogen atom.

In the atomic group represented by Q, it is preferable that structures composed of carbon atoms form the 6-membered ring represented by formula (II). In formula (II), the groups represented by $R^8$, $R^9$, $R^{10}$ and $R^{11}$ each represents a group selected from the groups defined for $R^2$, $R^3$, $R^4$, $R^5$, and $R^6$, with hydrogen atoms being particularly preferable.

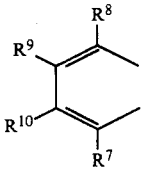

(II)

The structures represented by formulae (III) and (IV) are preferable for atomic groups represented by Q containing at least one nitrogen atom.

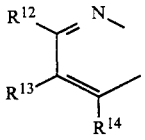

(III)

-continued (IV)

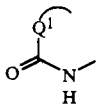

In formula (III), the groups represented by $R^{12}$, $R^{13}$, and $R^{14}$ each represents a group selected from the groups as defined for $R^2$, $R^3$, $R^4$, $R^5$, and $R^6$, with hydrogen atoms being particularly preferable.

$Q^1$ in formula (IV) represents a divalent amino group, an ether bond, a thioether bond, an alkylene group, an ethylene bond, an imino bond, a sulfonyl group, a carbonyl group, an arylene group, a divalent hetero ring group or a group that is a combination of two or more of these.

Particularly preferable among these are structures represented by the following formulae:

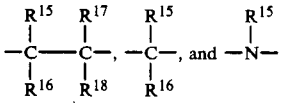

wherein $R^{15}$, $R^{16}$, $R^{17}$, and $R^{18}$ each represents a hydrogen atom or a group that can be substituted on the carbon atom or nitrogen atom (specifically an alkyl group, a cycloalkyl group, an aryl group, or a halogen atom).

$R^1$ represents an alkyl group including a substituted alkyl group (preferably with 1–12 carbon atoms; for example, methyl, ethyl, propyl, butyl), an alkoxy group including a substituted alkoxy group (preferably with 1–12 carbon atoms; for example, methoxy, ethoxy, methoxyethoxy, isopropoxy), a halogen atom (for example, bromine, fluorine, chlorine), an acylamino group [preferably an alkylcarbonylamino group with 2–12 carbon atoms (for example, acetylamino, propionylamino, cyanoacetylamino) or an arylcarbonylamino group with 7–15 carbon atoms (for example, benzoylamino, p-toluylamino, pentafluorobenzoylamino, m-methoxybenzoylamino)], an alkoxycarbonyl group including a substituted alkoxycarbonyl group (preferably with 2–13 carbon atoms; for example, methoxycarbonyl, ethoxycarbonyl), a cyano group, a sulfonylamino group (preferably with 1–10 carbon atoms; for example, methanesulfonylamino, ethanesulfonylamino,N-methylmethanesulfonylamino),a carbamoyl group [preferably an alkylcarbamoyl group with 2–12 carbon atoms (for example, methylcarbamoyl, dimethylcarbamoyl, butylcarbamoyl, isopropylcarbamoyl, t-butylcarbamoyl, cyclopentylcarbamoyl, cyclohexylcarbamoyl, methoxyethylcarbamoyl, chloroethylcarbamoyl, cyanoethylcarbamoyl, ethylcyanoethylcarbamoyl, benzylcarbamoyl, ethoxycarbonylmethylcarbamoyl, furfurylcarbamoyl, tetrahydrofurfurylcarbamoyl, phenoxymethylcarbamoyl, allylcarbamoyl, crotylcarbamoyl, prenylcarbamoyl 2,3-dimethyl2-butenylcarbamoyl, homoallylcarbamoyl, homocrotylcarbamoyl, and homoprenylcarbamoyl), an arylcarbamoyl group with 7–15 carbon atoms (for example, phenylcarbamoyl, p-toluylcarbamoyl, m-methoxyphenylcarbamoyl, 4,5-dichlorophenylcarbamoyl, p-cyanophenylcarbamoyl, p-acetylaminophenylcarbamoyl, p-methoxycarbonylphenylcarbamoyl, m-trifluoromethylphenylcarbamoyl, o-fluorophenylcarbamoyl, 1-naphthylcarbamoyl), or a heterylcarbamoyl group with 4–12 carbon atoms (for example, 2-pyridylcarbamoyl, 3-pyridylcarbamoyl, 4-pyridylcarbamoyl, 2-thiazolylcarbamoyl, 2-benzothiazolylcarbamoyl, 2-benzimidazolylcarbamoyl, 2-(4-methyl)-1,3,4-thiadiazolylcarbamoyl)], a sulfamoyl group (preferably with 0–12 carbon atoms; for example, methylsulfamoyl, dimethylsulfamoyl), an aminocarbonylamino group including a substituted aminocarbonylamino group (preferably with 1–10 carbon atoms; for example, methylaminocarbonylamino, dimethylaminocarbonylamino), or an alkoxycarbonylamino group including a substituted alkoxycarbonylamino group (preferably with 2–10 carbon atoms; for example, methoxycarbonylamino, ethoxycarbonylamino).

A carbamoyl group with 2–7 carbon atoms is preferable as the group for $R^1$ when Q is a structure represented by formula (II) or (III). When Q is a structure represented by formula (IV), the preferred group is an acylamino group with 2–7 carbon atoms.

$R^2$, $R^3$, $R^4$, $R^5$ and $R^6$ each represents a hydrogen atom or a group selected from the groups as defined for $R^1$.

Preferred for $R^2$, $R^4$, $R^5$ and $R^6$ are hydrogen atoms.

Preferred groups for $R^3$ are a hydrogen atom, an alkyl group with 1–4 carbon atoms, an alkoxy group with 1–3 carbon atoms, a halogen atom (for example, fluorine, chlorine, bromine), an acylamino group with 1–4 carbon atoms, a sulfonylamino group with 0–4 carbon atoms, an aminocarbonylamino group with 1–4 carbon atoms, or an alkoxycarbonylamino group with 1–4 carbon atoms.

$R^7$ represents a hydrogen atom, an alkyl group including a substituted alkyl group (preferably with 1–12 carbon atoms; for example, methyl, ethyl, propyl, isopropyl, butyl, 2-methoxyethyl, 3-methoxypropyl, ethoxyethyl, 2-phenylethyl, 2-cyanoethyl, cyanomethyl, 2-chloroethyl, 3-bromopropyl, 2-methoxycarbonylethyl, 3-ethoxycarbonylpropyl, 2-(N-methylaminocarbonyl)ethyl, 3-(N,N-dimethylaminocarbonyl)propyl, 2-acetylaminoethyl, 3-(ethylcarbonylamino)propyl), or an aryl group including a substituted aryl group (preferably with 6–14 carbon atoms; for example, phenyl, p-tolyl, p-methoxyphenyl, 2,4-dichlorophenyl, p-nitrophenyl, 2,4-dicyanophenyl, 2-naphthyl).

$R^7$ is preferably an alkyl group with 1–4 carbon atoms.

Alternatively, at least one of $R^4$ and $R^7$, $R^3$ and $R^4$, and $R^5$ and $R^6$ may be taken together to form a ring.

The hydrogen atoms of the groups represented by $R^1$–$R^{18}$ may be substituted still further by other substituent groups.

Specific examples of the dyes represented by formula (I) and used in this invention are listed below.

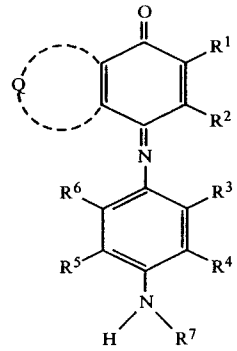
| No. | Q | $R^1$ | $R^3$ | $R^2$ $R^4$ $R^5$ $R^6$ | $R^7$ |
|---|---|---|---|---|---|
| 1 | 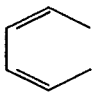 | 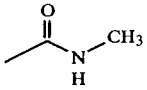 | —H | —H —H —H —H | $-C_2H_5$ |
| 2 | " | " | $-OCH_3$ | " | " |
| 3 | " | " | 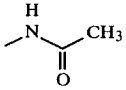 | " | " |
| 4 | " | " | 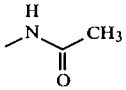 | " | 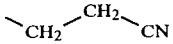 |
| 5 | 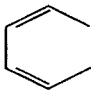 | 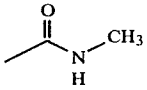 | 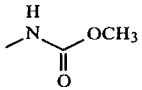 | —H —H —H —H | 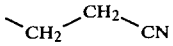 |
| 6 | " | 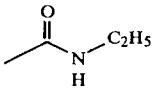 | $-CH_3$ | " | $-C_2H_5$ |
| 7 | " | " | $-OCH_3$ | " | 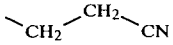 |

-continued
| | | | | | |
|---|---|---|---|---|---|
| 8 | " | " | 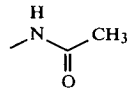 | " | $-C_2H_5$ |
| 9 | " | " | " | " | 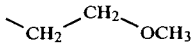 |
| 10 | " | " | 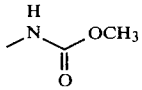 | " | $-C_2H_5$ |
| 11 | 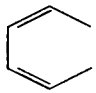 | 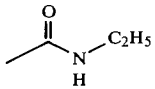 | 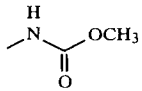 | $-H$ $-H$ $-H$ $-H$ | 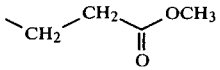 |
| 12 | " | " | " | " | 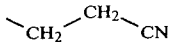 |
| 13 | " | 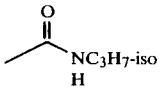 | $-CH_3$ | " | $-C_3H_7$ |
| 14 | " | 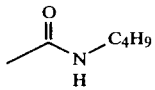 | $-OCH_3$ | " | $-C_4H_9$-t |
| 15 | " | " | 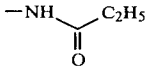 | " | $-C_4H_9$ |
| 16 | " | 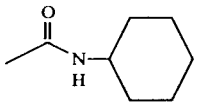 | 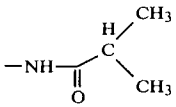 | " | $-C_3H_7$-iso |
| 17 | 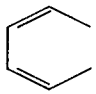 | 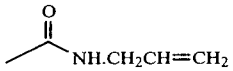 | 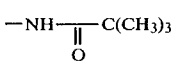 | $-H$ $-H$ $-H$ $-H$ | $-C_5H_{11}$ |

-continued
| | | | | | |
|---|---|---|---|---|---|
| 18 | " | 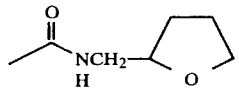 | 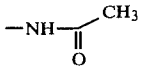 | " | $-C_2H_5$ |
| 19 | " | " | $-OCH_3$ | " | " |
| 20 | " | 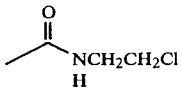 | $-CH_3$ | " | 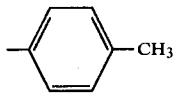 |
| 21 | " | 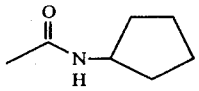 | $-OCH_3$ | " | $-C_3H_7$ |
| 22 | " | 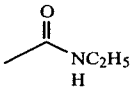 | $-C_2H_5$ | " | $-C_2H_5$ |
| 23 | 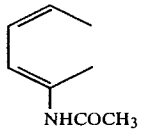 | 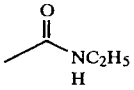 | $-C_2H_5$ | $-H$ $-H$ $-H$ $-H$ | $-C_2H_5$ |
| 24 | 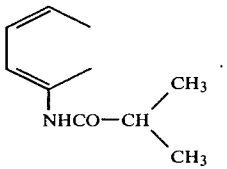 | 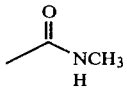 | " | " | " |
| 25 | 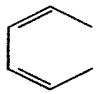 | 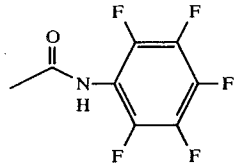 | $-CH_3$ | " | " |

-continued
| | | | | | |
|---|---|---|---|---|---|
| 26 | " | 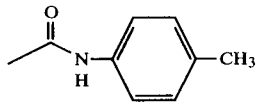 | " | " | $-CH_2CH_2-NHSO_2CH_3$ |
| 27 | " | 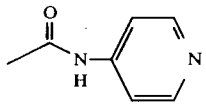 | $-OCH_3$ | " | $-C_3H_7$ |
| 28 | " | 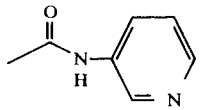 | " | " | " |
| 29 | 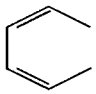 | 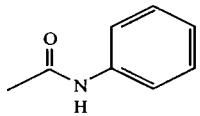 | $-H$ | $-H$ $-H$ $-H$ $-H$ | $-C_2H_5$ |
| 30 | " | " | 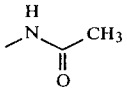 | " | 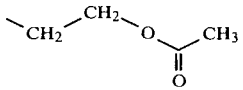 |
| 31 | " | 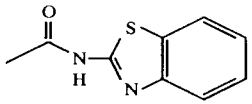 | $-OC_2H_5$ | " | $-C_2H_5$ |
| 32 | " | 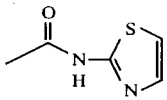 | 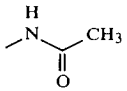 | " | 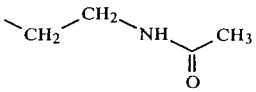 |
| 33 | " | 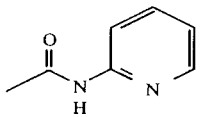 | $-H$ | " | $-C_2H_5$ |

-continued
| | | | | | |
|---|---|---|---|---|---|
| 34 | 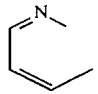 | 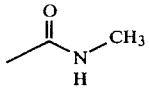 | H | " | " |
| 35 | 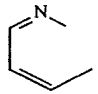 | 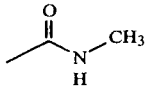 | $-OCH_3$ | $-H$ $-H$ $-H$ $-H$ | 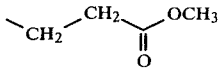 |
| 36 | " | " | 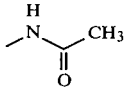 | " | " |
| 37 | " | " | $-CH_3$ | " | $-C_2H_5$ |
| 38 | " | " | 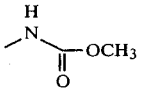 | " | 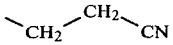 |
| 39 | " | 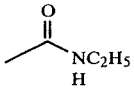 | $-H$ | " | $-C_2H_5$ |
| 40 | " | 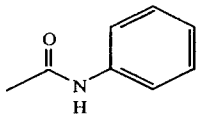 | $-H$ | " | " |
| 41 | 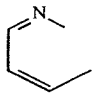 | 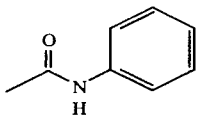 | 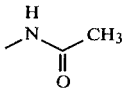 | $-H$ $-H$ $-H$ $-H$ | 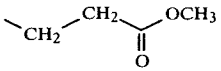 |
| 42 | " | 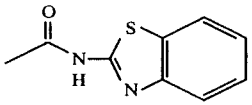 | H | " | $-C_2H_5$ |
| 43 | " | " | 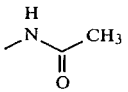 | " | 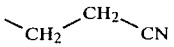 |

-continued
| | | | | | |
|---|---|---|---|---|---|
| 44 | " | 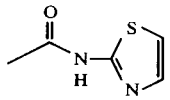 | 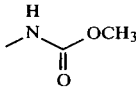 | " | " |
| 45 | 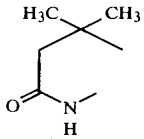 | 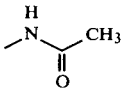 | 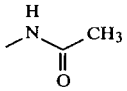 | " | $-C_2H_5$ |
| 46 | " | 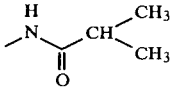 | 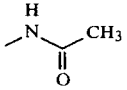 | " | " |
| 47 | 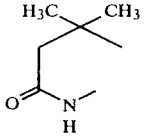 | 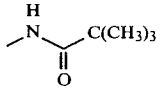 | 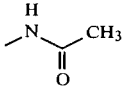 | $-H\ -H\ -H\ -H$ | 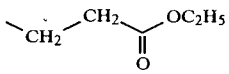 |
| 48 | " | " | 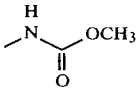 | " | $-C_2H_5$ |
| 49 | " | 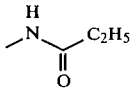 | 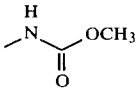 | " | 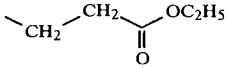 |
| 50 | " | " | $-OCH_3$ | " | $-C_2H_5$ |
| 51 | " | 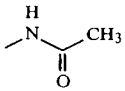 | $-CH_3$ | " | $-C_3H_7$ |
| 52 | " | 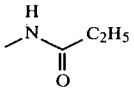 | 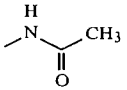 | " | $-C_2H_5$ |

-continued
| | | | | | |
|---|---|---|---|---|---|
| 53 | 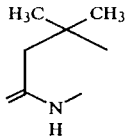 | 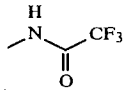 | 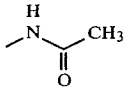 | —H —H —H —H | —$C_2H_5$ |
| 54 | " | " | 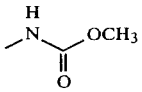 | " | " |
| 55 | " | " | —$OCH_3$ | " | " |
| 56 | " | 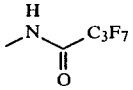 | —$CH_3$ | " | " |
| 57 | " | 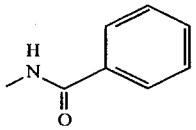 | 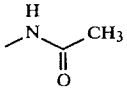 | " | " |
| 58 | " | " | 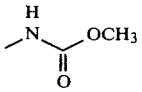 | " | " |
| 59 | 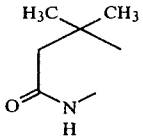 | 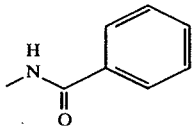 | —$OCH_3$ | —H —H —H —H | —$C_2H_5$ |
| 60 | " | " | —$CH_3$ | " | " |
| 61 | " | 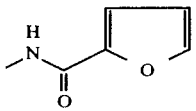 | 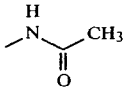 | " | " |

-continued
| | | | | | |
|---|---|---|---|---|---|
| 62 | " | " | 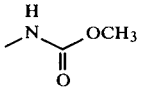 | " | " |
| 63 | " | 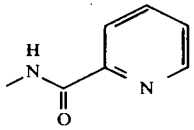 | $-OCH_3$ | " | " |
| 64 | " | 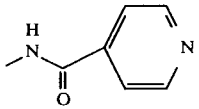 | $-CH_3$ | " | " |
| 65 | 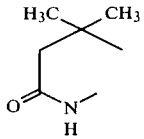 | 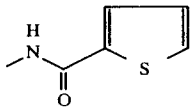 | 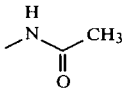 | $-H$ $-H$ $-H$ $-H$ | $-C_2H_5$ |
| 66 | " | " | 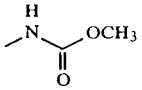 | " | " |
| 67 | " | " | $-OC_2H_5$ | " | " |
| 68 | " | 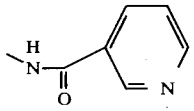 | $-CH_3$ | " | " |
| 69 | 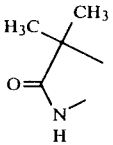 | 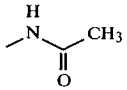 | 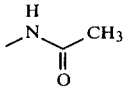 | " | " |
| 70 | " | " | 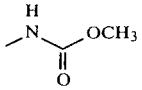 | " | " |

-continued
| | | | | | |
|---|---|---|---|---|---|
| 71 | 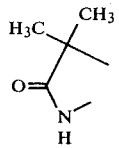 | 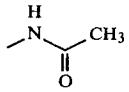 | $-OCH_3$ | $-H$ $-H$ $-H$ $-H$ | $-C_2H_5$ |
| 72 | " | 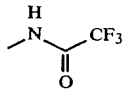 | 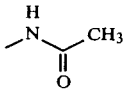 | " | " |
| 73 | " | " | $-OCH_3$ | " | " |
| 74 | " | 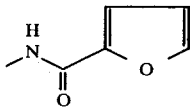 | 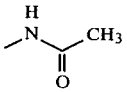 | " | " |
| 75 | " | " | $-OCH_3$ | " | " |
| 76 | 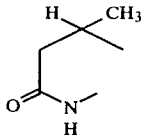 | 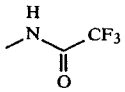 | 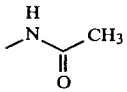 | " | " |
| 77 | 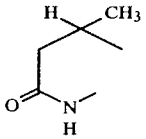 | 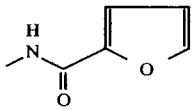 | $-OCH_3$ | $-H$ $-H$ $-H$ $-H$ | $-C_2H_5$ |
| 78 | 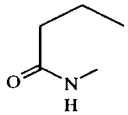 | 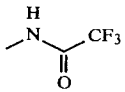 | 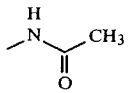 | " | " |
| 79 | 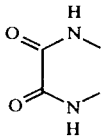 | 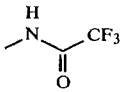 | $-OCH_3$ | " | " |

-continued
| | | | | | |
|---|---|---|---|---|---|
| 80 | 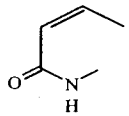 | 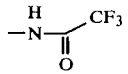 | $-OC_2H_5$ | " | $-C_4H_9$ |
| 81 | 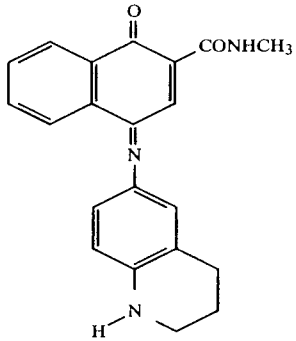 | | | | |
| 82 | 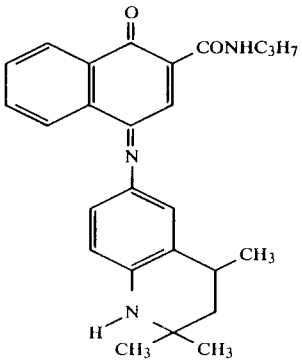 | | | | |

-continued
| | |
|---|---|
| 83 | 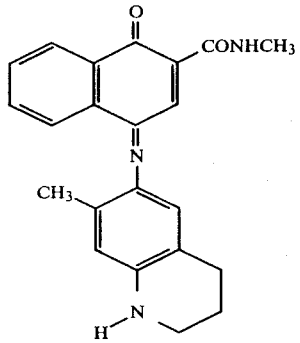 |
| 84 | 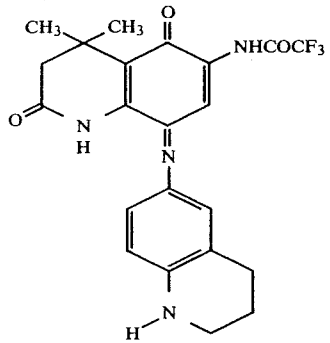 |

The dyes used in the invention can be synthesized easily by condensing the following compounds:

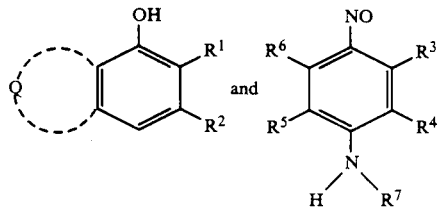

The following is an example of such synthesis.

SYNTHESIS EXAMPLE

Synthesis of Ddye No. 1:

2.0 ml of acetic anhydride was added dropwise to a mixture of 3.4 g of 2-methylcarbamoyl-1-naphthol, 3.0 g of 4-nitroso-N-ethylaniline, and 68 ml of ethanol, which was well agitated at room temperature. After 20 minutes of the agitation, the deposited crystals were filtered off and recrystallized from methanol to obtain 4.0 g (yield: 71%) of Dye No. 1 having a melting point of 193°-194° C.

Other dyes in accordance with the invention can be prepared analogously selecting appropriate starting compounds.

The heat transfer dye providing material of this invention has as its main feature the use of a specific dye such as the above, and has as a first embodiment mode a mode which uses the thermo-migratability of a dye such as the above. A heat transfer dye providing material of this invention in this mode is obtained by dissolving or dispersing a dye of this invention and a binder resin in a suitable solvent and preparing a coating composition, coating this coating composition on one surface of the support in a coated amount so as to have a dry film thickness of, for example, approximately from 0.2 to 5.0 μm, preferably from 0.4 to 2.0 μm, and drying to form a heat transfer dye providing layer.

As the binder resin used together with the above dye, any of the binder resins used for this kind of purpose in the art can be used, and those which have a high heat resistance and which do not prevent migration of the dye when heated are normally selected. Examples include a polyamide-based resin, a polyester-based resin, an epoxy resin, a polyurethane-based resin, a polyacrylic resin (for example, polymethyl methacrylate, polyacrylamide), polyvinyl pyrrolidone and other vinyl-based resins, a polyvinyl chloride-based resin (for example, vinyl chloride-vinyl acetate copolymers), a polycarbonate-based resin, polysulfone, polyphenylene oxide, a cellulose-based resin (for example, methyl cellulose, ethyl cellulose, carboxymethyl cellulose, cellulose acetate hydrogenphthalate, cellulose acetate, cellulose acetate propionate, cellulose acetate butyrate, cellulose triacetate), a polyvinyl alcohol-based resin (for example, polyvinyl alcohol, partially saponified polyvinyl alcohols such as polyvinyl butyral), a petroleum-based resin, a rosin derivative, a coumarone-indene resin, a terpene-based resin, a novolak type phenolic resin, a polystyrene-based resin, and a polyolefin-based resin (for example, polyethylene, polypropylene).

This kind of binder resin is preferably used in the proportion of approximately from 80 to 600 parts per 100 parts by weight of the dye.

Any solvent known in the art can be freely used as the solvent used in the invention to dissolve or disperse the above dye and binder resin. Specific examples include water, alcohols (for example, methanol, ethanol, isopropyl alcohol, butanol, isobutanol), esters (for example, ethyl acetate, butyl acetate), ketones (for example, methyl ethyl ketone, methyl isobutyl ketone, cyclohexanone), aromatic solvents (for example, toluene, xylene, chlorobenzene), halogen-based solvents (for example, dichloromethane, trichloroethane, chloroform), N,N-dimethylformamide, N-methylpyrrolidone, dioxane, terahydrofuran, and cellulose-based solvents (for example, methyl cellosolve, ethyl cellosolve), or mixtures of the above solvents. It is important that these solvents be selected for their ability to dissolve or disperse the dye being used to the required concentration and the binder resin adequately. For example, it is preferable that the weight of solvent used be approximately from 9 to 20 times the combined weight of the dye and binder resin.

Dyes employed in the invention may be used singly or in combinations of two or more. Dyes used in the invention may also be combined with dyes known in the art.

Dyes employed in the invention may be used together with a color fading-preventing agent known in the art.

Any material with a degree of heat resistance and strength known in the art may be used as the support used in the structure of the heat transfer dye providing material of the invention. For example, paper, any kind of processed paper, polysters (for example, polyethylene terephthalate); polyamides; polycarbonates; glassine paper; condenser paper; cellulose ester; fluorocarbon polymers; polyethers; polyacetal; polyolefins; polyimides, polyphenylene sulfide, polypropylene, polystyrene, and cellophane. Polyester films are especially preferable.

The coating of the dye providing layer on the base film may be carried out using a reverse roll coater, a gravure coater, a micro gravure coater, a rod coater, an air doctor coater, or the like.

The heat transfer dye providing material as described above is of sufficient use in the invention as it is, but it may be provided in addition with an anti-adhesion layer, in other words a separator layer, on the surface of the dye bearing layer, and, by providing this layer, adhesion between the heat transfer dye providing material and the image receiving material during heat transfer is prevented, and a higher heat transfer temperature is used to form an image of even better temperature.

This separator layer will show considerable results even if it is adhered only with a simple anti-adhesive inorganic powder, but it can also preferably be formed by providing a separator layer having a thickness of from 0.01 to 5 μm, preferably from 0.05 to 2 μm, of a resin with superior separation characteristics, for example, a silicone polymer, an acrylic polymer, or a fluorocarbon polymer.

Adequate results will be obtained even if the dye providing layer contains an inorganic powder or a separating type polymer such as the above.

Furthermore, a heat resistant layer may be provided on the surface of the heat transfer dye providing material of the invention to prevent any detrimental effect from the heat of the thermal head.

A dye-barrier layer comprising a hydrophilic polymer may also be used between the dye layer and the support in the dye donator material, and this will improve the dye transfer density.

The heat transfer dye providing material of the invention in its preferred mode obtained as described above can be placed against heat transfer image receiving material known in the art, and by heating from either side, preferably from the surface of the heat transfer dye providing material, in accordance with the picture signals using, for example, a thermal head or other heating means, the dye in the heat transfer dye providing layer is easily transferred, in accordance with the amount of heat energy, and migrates to the image receiving layer of the heat transfer image receiving material using relatively little energy, to form a color image that has excellent sharpness and resolution gradation.

According to preferred modes of the invention, the heat transfer dye providing material has the form of a sheet or a continuous ribbon or roll. A layer of cyan dye of the invention may be provided on this alone, or layers of yellow, magenta, and in some cases black dyes known in the art may also be provided in separate parts. In a preferred mode, dye providing layers of each color containing yellow, magenta, cyan (and in some cases black) thermomigrating dyes, in other words domains of yellow, magenta, cyan (and in some cases black) are arranged in a repeating order to form a heat transfer dye providing material.

When using this kind of heat transfer dye providing material to carry out full color recording, when, for example, the cyan dye providing layer (cyan dye domain) is being pressed against the heat transfer image receiving material, a single screen of cyan transfer is carried out using the color signal corresponding to cyan to make each head element in the thermal head generate a heating pattern corresponding to a single scan line picture element, the operation of transferring cyan dye in the dye providing layer to the image receiving layer in the heat transfer image receiving material being carried out by transferring one scan line at a time for both the heat transfer dye providing material and the heat transfer image receiving material in accordance with this heating pattern, and it is preferable to then repeat the same transfer process for the same screen with yellow, magenta (and in some cases black) in turn. Equipment employing this recording method is known in the art, and is disclosed, for example, in JP-A-62-1585.

The dyes employed in this invention can be used in a heat transfer dye providing material of a separate format to the one described above. In other words, a second preferred mode of the invention is one whereby the heat transfer dye providing layer in the heat transfer dye providing material is a heat fusible transfer layer comprising the dye of this invention and a wax as a binder. Heat transfer material of this mode is obtained by preparing an ink for forming a heat fusible transfer layer comprising wax containing the dye, and forming a heat fusible transfer layer from the ink on one surface of a support as described above. The ink uses as a binder waxes of a suitable melting point, for example, paraffin wax, microcrystalline wax, carnauba wax, and urethane-based waxes, in which the dye is blended and dispersed. The proportions of dye and wax used are preferably such that the dye constitutes about from 10 to 65% by weight of the heat fusible transfer layer formed, the thickness of the layer being preferably within the range of about from 1.5 to 6.0 μm. Its manufacture and application to the support may be carried out using existing technology.

If used in the same way as the first preferred mode, with the above second preferred mode of heat transfer dye providing material of this invention, the heat fusible transfer layer will be transferred to the recording material to produce an excellent imprint.

The transferred image obtained by using the cyan dye of the invention which is represented by formula (I) is extremely stable with respect to light.

The manufacture of heat transfer dye providing material and heat transfer image receiving material, and printing and thermal image transfer experiments were carried out for both the following Example and Comparative Example.

EXAMPLE AND COMPARATIVE EXAMPLE

Production of heat transfer dye providing material (1)

Using as a support a polyethylene terephthalate film (Lumirror ®, made by Toray Industries, Inc.) of 6 μm thickness and of which one side had been subjected to a corona discharge treatment, a thermal transfer dye providing layer coating composition (1) of the composition below was coated onto the corona discharge-treated side of the film using wire bar coating so that the dry thickness was 1 μm. On the back side of the material, a poly(vinyl stearate) (0.3 g/m$^2$) slipping layer in polyvinyl butyral (Butvar ®-76, made by Monsanto Company) (0.45 g/m$^2$) was coated with a tetrahydrofuran solvent.

COATING COMPOSITION FOR HEAT TRANSFER LAYER (1)

| | |
|---|---|
| Dye No. 1 | 4 g |
| Polyvinyl butyral resin (Denka ® Butyral 5000-A, made by Denki Kagaku Kogyo K.K.) | 4 g |
| Toluene | 40 ml |
| Methyl ethyl ketone | 40 ml |
| Polyisocyanate (Takenate ® D110N, made by Takeda Chemical Industries, Ltd.) | 0.2 ml |

By substituting other dye compounds, the heat transfer dye providing materials (2)–(6) and a material for comparison (a) as shown in Table 1 were made. (Production of the heat transfer image receiving material)

Using a synthetic paper (YUPO ®-FPG-150, made by Oji Yuka Synthetic Paper Co., Ltd.) of 150 μm thickness as a support, an image receiving layer coating composition (1) of the composition below was coated onto the surface using wire bar coating to form a heat transfer image receiving material (1) with a dry thickness of 5 μm. After half-drying the material in a drier, it was dried in an oven at 100° C. for 30 minutes.

Image receiving layer coating composition (1)

| | |
|---|---|
| Polyester resin (Vylon ® 290 made by Toyobo Co., Ltd.) | 20 g |
| Amino-modified silicone oil (KF-857, Shin-Etsu Silicone Co., Ltd.) | 0.5 g |
| Methyl ethyl ketone | 85 ml |
| Toluene | 85 ml |
| Cyclohexanone | 30 ml |

The heat transfer dye providing material and heat transfer image receiving material thus obtained were placed together so that the heat transfer dye providing layer and the heat transfer image receiving layer were in contact, and using a thermal head from the support side of the heat transfer dye providing material, printing was carried out with an output from the thermal head of 0.25 W/dot, a pulse width of from 0.15 to 15 m/sec, and a dot density of 6 dots per mm. When the cyan colored dye was imagewise dyed into the image receiving layer of the heat transfer image receiving material, a clear image record with no transfer irregularities was obtained from all the test materials.

The heat transfer image receiving materials on which images had been recorded were placed for 7 days in a test equipment for testing the light resistance at 12,000 lux of a fluorescent light in order to investigate the stability of the dye. The status A reflective density was measured before and after the test, and the degree of light fastness under bright storage conditions was evaluated from the ratio of the two. The results are shown in Table 1.

The degree of light fastness of the cyan dye in the invention was outstanding.

TABLE 1

| No. | | Dye No. | Light fastness* (remainder rate) |
|---|---|---|---|
| 1 | Invention | 1 | 92 |
| 2 | " | 2 | 93 |
| 3 | " | 3 | 95 |
| 4 | " | 6 | 93 |
| 5 | " | 53 | 94 |
| 6 | " | 61 | 93 |
| 7 | Comparison | a | 88 |

*The dye remainder rate (%) after exposure to a 12,000 lux fluorescent light for 1 week.

Comparative dye a:

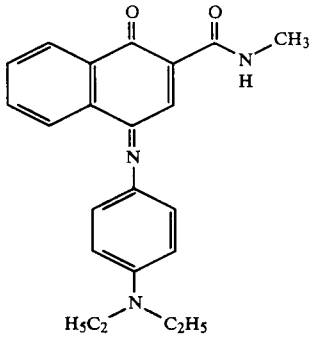

While the invention has been described in detail and with reference to specific embodiments thereof, it will be apparent to one skilled in the art that various changes and modifications can be made therein without departing from the spirit and scope thereof.

We claim:

1. A heat transfer dye providing material having on a support a dye providing layer containing a binder and a dye represented by formula (I):

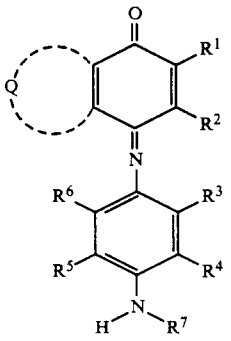

(I)

wherein

Q represents a 6-membered carbocyclic ring represented by formula (II):

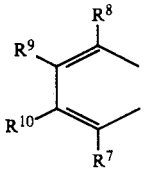

(II)

wherein:

$R^8$, $R^9$, $R^{10}$, and $R^{11}$ each represents a group selected from the groups as defined for $R^2$, $R^3$, $R^4$, $R^5$, and $R^6$;

$R^1$ represents an alkyl group, an alkoxy group, a halogen atom, an acylamino group, an alkoxycarbonyl group, a cyano group, a sulfonylamino group, a carbamoyl group, a sulfamoyl group, an aminocarbonylamino group, or an alkoxycarbonylamino group;

$R^2$, $R^3$, $R^4$, $R^5$ and $R^6$ each represents a hydrogen atom or a group selected from the groups as defined for $R^1$;

$R^7$ represents a hydrogen atom, an alkyl group, or an aryl group; and at least one of $R^4$ and $R^7$, and $R^3$ and $R^4$, and $R^5$ and $R^6$ may be taken together to form a ring.

2. A heat transfer dye providing material as in claim 1, wherein $R^2$, $R^4$, $R^5$, and $R^6$ each represents a hydrogen atom, $R^3$ represents a hydrogen atom, an alkyl group with 1–4 carbon atoms, an alkoxy group with 1–3 carbon atoms, a halogen atom, an acylamino group with 1–4 carbon atoms, a sulfonylamino group with 0–4 carbon atoms, or an alkoxycarbonylamino group with 1–4 carbon atoms; and $R^7$ represents an alkyl group with 1–4 carbon atoms.

3. A heat transfer dye providing material as in claim 1, wherein said dye providing layer has a dry film thickness of about from 0.2 to 5.0 μm and includes a binder in a proportion of from 80 to 600 parts per 100 parts by weight of the dye.

* * * * *